US011408662B2

(12) United States Patent
Lee et al.

(10) Patent No.: US 11,408,662 B2
(45) Date of Patent: Aug. 9, 2022

(54) REFRIGERATOR

(71) Applicant: LG ELECTRONICS INC., Seoul (KR)

(72) Inventors: Sunghun Lee, Seoul (KR); Yoonseong Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 566 days.

(21) Appl. No.: 16/509,191

(22) Filed: Jul. 11, 2019

(65) Prior Publication Data

US 2019/0331394 A1 Oct. 31, 2019

Related U.S. Application Data

(63) Continuation of application No. 15/244,865, filed on Aug. 23, 2016, now Pat. No. 10,371,433.

(30) Foreign Application Priority Data

Sep. 11, 2015 (KR) ..... 10-2015-0129241

(51) Int. Cl.

| | |
|---|---|
| ***F25D 11/02*** | (2006.01) |
| ***F25D 17/04*** | (2006.01) |
| ***F25D 17/06*** | (2006.01) |
| ***F25D 25/02*** | (2006.01) |

(52) U.S. Cl.

CPC ..... *F25D 17/045* (2013.01); *F25D 11/02* (2013.01); *F25D 17/065* (2013.01); *F25D 25/025* (2013.01); *F25D 2317/061* (2013.01); *F25D 2600/04* (2013.01)

(58) Field of Classification Search

CPC ..... F25D 11/02; F25D 17/045; F25D 17/065; F25D 2317/061; F25D 25/025; F25D 2600/04

See application file for complete search history.

(56) References Cited

U.S. PATENT DOCUMENTS

| | | | | |
|---|---|---|---|---|
| 1,943,646 A | 1/1934 | Warren | | |
| 2,255,503 A | 9/1941 | Carbary | | |
| 2,846,934 A | 8/1958 | Mauldin | ..... | B64D 13/02 137/81.1 |
| 3,192,613 A | 7/1965 | Allen | ..... | F16K 27/105 251/189 |

(Continued)

FOREIGN PATENT DOCUMENTS

| | | |
|---|---|---|
| CN | 1024296 C | 4/1994 |
| CN | 1122674 A | 5/1996 |

(Continued)

*Primary Examiner* — Filip Zec

(74) *Attorney, Agent, or Firm* — Dentons US LLP

(57) ABSTRACT

A refrigerator including a refrigerator main body having a refrigerating chamber therein, a cold air passage duct provided within the refrigerator main body and having a cold air passage therein to discharge the cold air into the refrigerating chamber, a control case attached to one surface of the cold air discharge duct and having a cold air discharge opening through which the cold air is discharged, and a knob provided between the cold air passage duct and the control case and attached to the control case to be reciprocally movable in one direction, the knob opening and closing at least part of the cold air discharge opening.

11 Claims, 8 Drawing Sheets

(56) References Cited

U.S. PATENT DOCUMENTS

| | | | | |
|---|---|---|---|---|
| 3,866,437 | A | 2/1975 | Spencer | F25D 17/045 62/408 |
| 4,250,719 | A | 2/1981 | Grimm | F25D 17/045 62/382 |
| 4,802,040 | A | 1/1989 | Komatsu | G11B 5/5521 360/267.1 |
| 4,850,206 | A | 7/1989 | Larsen | |
| 4,914,928 | A | 4/1990 | Fellwock | F25D 17/045 62/408 |
| 5,048,306 | A | 9/1991 | Wakatsuki | F25D 17/045 62/419 |
| 5,092,136 | A | 3/1992 | Kang | F04D 29/4246 137/872 |
| 5,172,566 | A | 12/1992 | Jung | F25D 17/045 236/78 C |
| 5,375,413 | A | 12/1994 | Fredell | F24F 13/12 137/625.33 |
| 5,884,496 | A * | 3/1999 | Kim | F25D 17/045 62/186 |
| 6,069,466 | A | 5/2000 | Noritake | F16K 1/18 318/282 |
| 6,073,458 | A | 6/2000 | Kim | |
| 6,330,891 | B1 | 12/2001 | Noritake | F16K 1/18 137/595 |
| 6,904,761 | B2 | 6/2005 | Rafalovich | F25D 17/045 62/176.1 |
| 7,874,172 | B2 | 1/2011 | Cruz | F25D 17/045 236/49.5 |
| 8,550,290 | B1 | 10/2013 | Davis | A45C 13/02 206/223 |
| D798,346 | S * | 9/2017 | Pearson | F16K 31/042 D15/89 |
| 9,970,699 | B2 * | 5/2018 | Allard | F25D 17/045 |
| 2004/0255607 | A1 | 12/2004 | Barmann | A47B 57/562 62/407 |
| 2017/0082347 | A1 | 3/2017 | Lee | F25D 11/02 |

FOREIGN PATENT DOCUMENTS

| | | | |
|---|---|---|---|
| CN | 1209535 | A | 3/1999 |
| CN | 1513101 | A | 7/2004 |
| CN | 1514923 | A | 7/2004 |
| CN | 101231073 | A | 7/2008 |
| CN | 101512270 | A | 8/2009 |
| CN | 102333999 | A | 1/2012 |
| CN | 104956167 | A | 9/2015 |
| CN | 105716353 | A | 6/2016 |
| JP | 56-34277 | U | 4/1981 |
| JP | 63-123971 | A | 8/1988 |
| JP | 01-203876 | A | 8/1989 |
| JP | 2-64868 | U | 5/1990 |
| JP | 8-296943 | A | 11/1996 |
| KR | 1991-0005176 | Y1 | 7/1991 |
| KR | 20-0113426 | Y1 | 4/1995 |
| KR | 2001-0090935 | A | 10/2001 |
| KR | 10-2005-0018110 | A | 2/2005 |
| KR | 10-2010-0107168 | A | 10/2010 |
| KR | 10-2011-0037754 | A | 4/2011 |
| WO | 2004/015341 | A1 | 2/2004 |
| WO | 2016/050437 | A1 | 4/2016 |

* cited by examiner

REFRIGERATOR

CROSS-REFERENCE TO RELATED APPLICATION

This application is a Continuation of U.S. patent application Ser. No. 15/244,865, filed Aug. 23, 2016, now allowed, which claims priority under 35 U.S.C. § 119 and 35 U.S.C. § 365 to Korean Patent Application No. 10-2015-0129241, filed on Sep. 11, 2015, whose entire disclosure is hereby incorporated by reference.

BACKGROUND

1. Field

A refrigerator having a structure capable of adjusting a flow rate of cold air supplied into a refrigerator main body by a user's manual operation.

2. Background

In general, a refrigerator keeps foods such as meat, fish, vegetables, fruits, beverages and the like in a fresh state. A conventional refrigerator includes a refrigerator main body having storage spaces such as a freezing chamber, a refrigerating chamber, vegetable chambers, and the like, a refrigerating cycle device provided in the refrigerator main body, and a door mounted to one side of the refrigerator main body to open and close the storage spaces.

The refrigerating cycle device of the refrigerator is activated when temperature of the freezing chamber or the refrigerating chamber is more than a preset temperature. In response to the activation of the refrigerating cycle device, cold air is generated in an evaporator and then circulates along the storage spaces. While the cold air circulates along the storage spaces, the storage spaces are maintained at preset temperatures.

Refrigerators are classified into various types according to a method of circulating cold air, locations of a freezing chamber, and a refrigerating chamber, and a configuration of an evaporator.

As one example, refrigerators may include a refrigerator having a freezing chamber located above a refrigerating chamber, a refrigerator having a freezing chamber and a refrigerating chamber located side by side, a refrigerator having a freezing chamber located below a refrigerating chamber, and the like.

A chiller chamber may be formed at the lowermost portion of the refrigerating chamber. The chiller chamber may include a chiller chamber drawer, and a chiller chamber cover forming an upper surface of the chiller chamber drawer. The chiller chamber may be used to store meat and the like. The chiller chamber is preferably maintained at a relatively low temperature close to 0° C. To this end, a duct with a cold air passage is installed at a rear side of the chiller chamber so as to supply cold air into the chiller chamber. The amount of cold air should be adjusted according to an amount of meat kept in the chiller chamber or an external temperature.

A conventional refrigerator includes a damper or an insulating material installed in the duct, along which the cold air flows, to adjust the amount of cold air supplied into the refrigerating chamber. However, the damper or the insulating material are not manually controlled by a user, but automatically controlled in an electric manner. Moreover, the amount of cold air was controlled by electrically adjusting an opening and closing amount of the damper, which made it impossible to adjust the amount of cold air supplied into the refrigerating chamber according to a user's need. Additionally, cold air supplied to the refrigerating chamber along the duct was not uniformly supplied through a cold air discharge opening.

Furthermore, the electric control of the amount of cold air resulted in increased power consumption, as well as increased material costs due to the installation of the damper and electric components for controlling the damper.

SUMMARY OF THE INVENTION

The present disclosure is directed to providing a structure for adjusting a flow rate of cold air supplied into a refrigerating chamber according to a user's request in a manner of installing a knob, which is manually manipulated by a user.

Additionally, the present disclosure is directed to providing a cold air flow rate adjustment structure, capable of reducing power consumption and material costs and implementing a user-desired temperature.

Additionally, the present disclosure is directed to providing a structure capable of uniformly supplying cold air through a cold air discharge opening while supplying the cold air into a refrigerating chamber through the cold air discharge opening.

To achieve these and other advantages and in accordance with the purpose of this specification, as embodied and broadly described herein, there is provided a refrigerator including a main body having a refrigerating chamber therein, a cold air passage duct disposed within the main body, the cold air passage duct including a cold air passage to discharge cold air into the refrigerating chamber, a control case attached to one surface of the cold air discharge duct, the control case including a cold air discharge opening through which the cold air is discharged, a knob provided between the cold air passage duct and the control case, the knob being reciprocally movable in one direction to open and close at least part of the cold air discharge opening, wherein the control case includes a pressing protrusion to press against a lower end portion of the knob, the pressing protrusion provided below the cold air discharge opening and protruding toward the cold air passage duct, wherein the knob includes a flow rate adjusting portion to adjust an opening and closing amount of the cold air discharge opening in response to being pressed by the pressing protrusion, and wherein the flow rate adjusting portion includes a plurality of protrusions disposed at the lower end portion of the knob that are spaced apart from one another by a preset distance, and a slot cut off to enable an elastic transformation of the lower end portion of the knob when the protrusions are pressed by the pressing protrusion.

According to an aspect of the present disclosure, the control case includes a first protruding portion provided below a first side of the cold air discharge opening and protruding toward the cold air passage duct, whereby the first protruding portion contacts the lower end of the knob to limit a downward movement of the knob and guide a lateral movement of the knob, and a second protruding portion provided at one side of the pressing protrusion and protruding toward the cold air passage duct to limit the lateral movement of the knob, the second protruding portion being positioned such that the first protruding portion is disposed between the pressing protrusion and the second protruding portion.

According to an aspect of the present disclosure, the knob includes a first movement limit end portion provided at the lower end portion of the knob, whereby the first movement end portion contacts the first protruding portion to limit the downward movement of the knob and guide the lateral movement of the knob, and a second movement limit end portion formed at a lower end portion of a first side of the knob, whereby the second movement end portion is connected to the first movement limit end portion and contacts the second protruding portion to limit a movement of the knob in a first side direction.

According to an aspect of the present disclosure, the control case further includes a third protruding portion provided below a second side of the cold air discharge opening and protruding toward the cold air passage duct, whereby the third protruding portion contacts at least part of the knob to limit the downward movement of the knob and guide the lateral movement of the knob, and a fourth protruding portion protruding toward the cold air passage duct to limit the lateral movement of the knob, the fourth protruding portion being positioned such that the third protruding portion is disposed between the pressing protrusion and the fourth protruding portion.

According to an aspect of the present disclosure, the knob further includes a third movement limit end portion formed by cutting off a lower end portion of a second side of the knob, whereby the third movement limit end portion contacts the third protruding portion to limit the downward movement of the knob and guide the lateral movement of the knob, a fourth movement limit end portion provided at the second side of the knob, whereby the fourth movement limit end portion is connected to the third movement limit end portion and contacts the fourth protruding portion to limit a movement of the knob in a second side direction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings:

FIG. 1(*b*) is a view of the refrigerator illustrated in FIG. 1(*a*) with the refrigerating chamber door and the freezing chamber door open to illustrate an interior of the refrigerator in accordance with the present disclosure;

DETAILED DESCRIPTION OF THE INVENTION

Hereinafter, exemplary embodiments of the present disclosure invention will be described in detail with reference to the accompanying drawings. It is understood that the description herein is not intended to limit the claims to the specific embodiments described. On the contrary, it is intended to cover alternatives, modifications, and equivalents as may be included within the spirit and scope of the present disclosure.

It is understood that although the terms first, second, etc. may be used herein to describe various elements, these elements should not be limited by these terms. These terms are generally only used to distinguish one element from another. Further, it is understood that when an element is referred to as being "connected with" another element, the element can be connected with the other element or intervening elements may also be present. In contrast, when an element is referred to as being "directly connected with" another element, there are no intervening elements present. Further, it is understood that a singular representation may include a plural representation unless it represents a definitely different meaning from the context. Further, it is understood that terms such as "include" or "has" are used herein and should be understood that they are intended to indicate an existence of features, numbers, steps, functions, several components, or combinations thereof, disclosed in the specification, and it is also understood that greater or fewer features, numbers, steps, functions, several components, or combinations thereof may likewise be utilized.

Figure 1A:
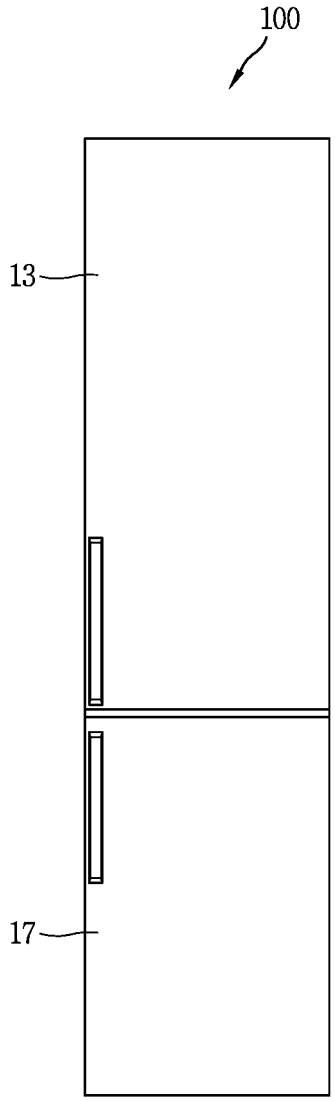
FIG. 1(*a*) is a conceptual view illustrating an exterior of a refrigerator in accordance with the present disclosure.
Figure 1B:
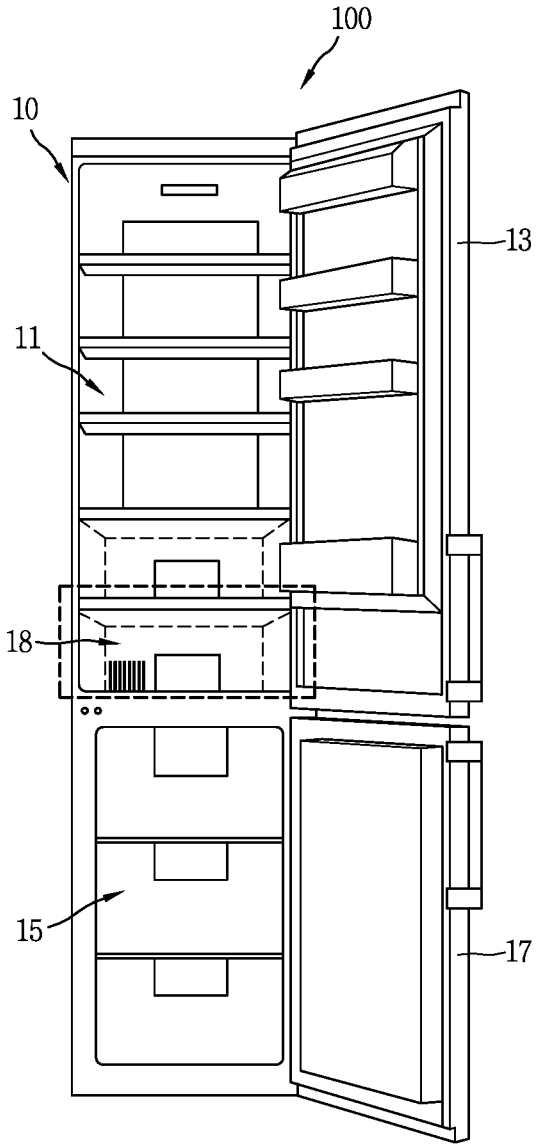
Figure 2:
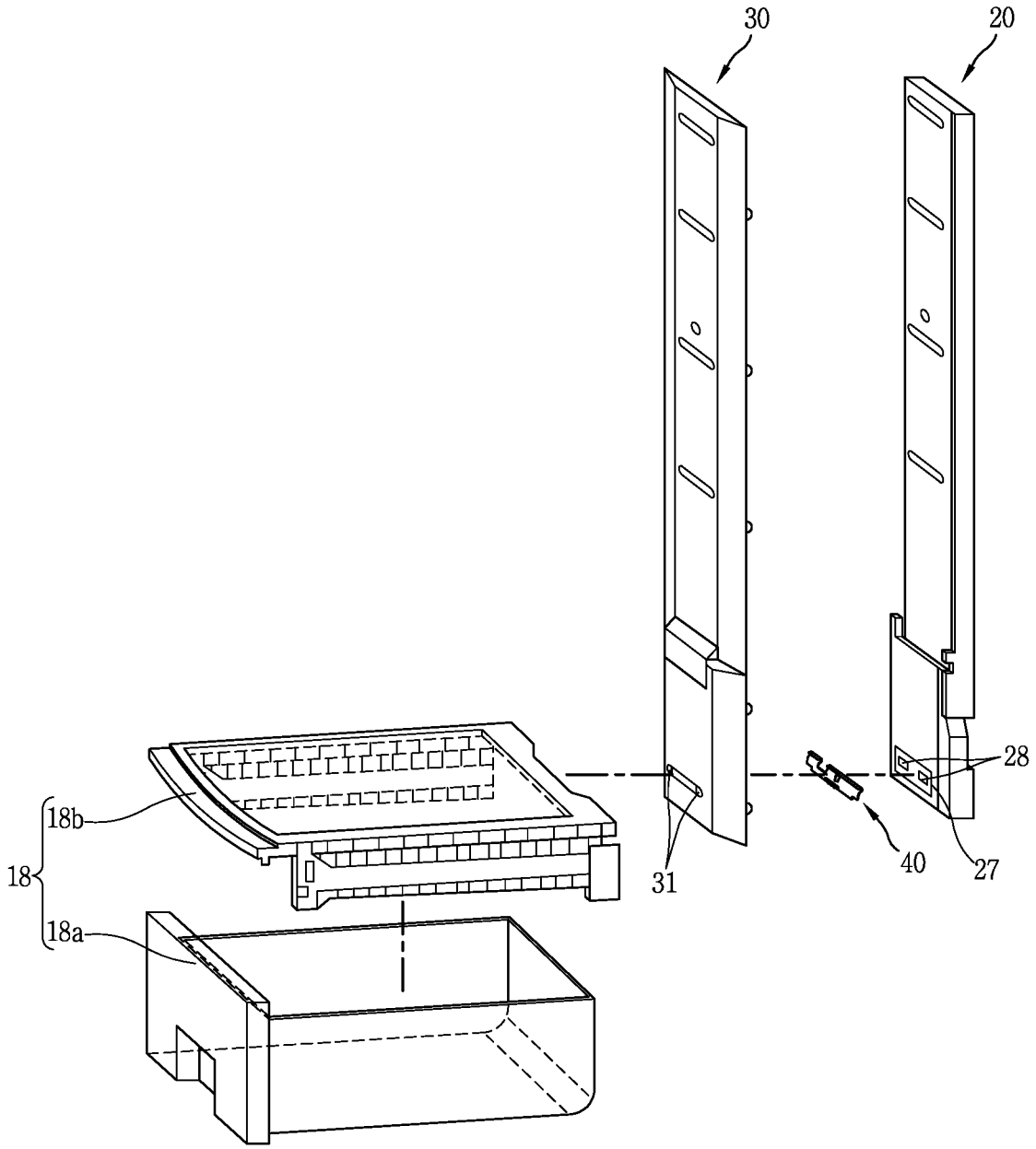
FIG. 2 is a disassembled perspective view illustrating the structure related to the refrigerator illustrated in FIG. 1.

FIG. 1(*a*) is a conceptual view illustrating an exterior of a refrigerator 100 in accordance with an embodiment of the present disclosure. FIG. 1(*b*) is a view of the refrigerator illustrated in FIG. 1(*a*) with the refrigerating chamber door and the freezing chamber door open to illustrate an interior of the refrigerator. FIG. 2 is a disassembled perspective view illustrating a structure related to the refrigerator 100 illustrated in FIGS. 1(*a*) and (*b*).

As illustrated in FIGS. 1(*a*) and (*b*) and 2, the refrigerator 100 may include a refrigerator main body 10, a cold air passage duct 20, a control case 30, and a knob 40. The refrigerator main body 10 may include a refrigerating chamber 11 and a freezing chamber 15. For example, the refrigerator disclosed herein may be a bottom freezer type refrigerator.

FIGS. 1(*a*) and (*b*) illustrates the bottom freezer type refrigerator 100. In the bottom freezer type refrigerator 100, a lower space is configured as the freezing chamber 16 and an upper space relative to the lower space is configured as the refrigerating chamber 11. A freezing chamber door 17 for opening and closing the freezing chamber 15 and a refrigerating chamber door 13 for opening and closing the refrigerating chamber 11 may be attached to the refrigerator main body 10.

The present disclosure is preferably applied to the bottom freezer type refrigerator, but is not limited thereto. It is understood that the present disclosure may be applied to various types of refrigerators by adjusting an arrangement of the knob 40, a cold air discharge opening 31, and the like, which are explained in more detail below.

Specifically, in the structure disclosed herein, a chiller chamber drawer 18*a* may be attached to the lowermost end of the refrigerating chamber 11, and a chiller chamber cover 18*b* that forms an upper surface of a chiller chamber 18 may be attached to an upper portion of the chiller chamber drawer 18*a*. Together, the chiller chamber drawer 18*a* and the chiller chamber cover 18*b* may be referred to as the chiller chamber 18. The chiller chamber 18 may store meat, and the like, and is preferably maintained at a relatively low temperature close to 0° C.

An introduction of cold air into the chiller chamber drawer 18*a* disposed at the lowermost end of the refrigerating chamber 11 should be allowed. A cold air passage duct 20*a* and the control case 30 may be provided at an upper portion of a rear surface of the chiller chamber drawer 18*a* and configured to communicate with the cold air discharge opening 31.

The cold air passage duct 20 may be installed within the refrigerator main body 10. The cold air passage duct 20 may include a cold air passage 23 (see e.g., FIG. 6). As illustrated in FIGS. 1(*a*) and (*b*) and 2, the cold air passage duct 20 may be disposed at a rear wall side of the refrigerating chamber 11 within the refrigerator main body to allow cold air to be discharged into the refrigerating chamber 11.

Cold air generated in an evaporator may flow along the cold air passage 23 of the cold air passage duct 20. In the cold air passage duct 20 of the present disclosure, similar to a conventional refrigerator, a refrigerating cycle is provided to supply cold air in response to a status change of a refrigerant. Components of the refrigerating cycle, such as an evaporator, a compressor, a condenser, and an expansion valve, are components applied to a refrigerating cycle of a conventional refrigerator, so for convenience purposes a detailed description thereof is omitted.

The control case 30 may be installed at one surface of the cold air passage duct 20. The control case 30 may be provided with the cold air discharge opening 31 through which cold air within the cold air passage duct 20 is discharged. The control case 30 may be understood as a plate structure coupled to one surface of the cold air passage duct 20. As illustrated in FIG. 2, the cold air passage duct 20 may be attached to a front surface of the cold air passage duct 20.

A knob accommodating portion 27 in which the knob 40 is accommodated to be reciprocally movable may be formed in the cold air passage duct 20. The knob accommodating portion 27 may be larger than the knob 40, considering the coupling with the reciprocally-movable knob 40. The knob accommodating portion 27 may be provided with the cold air discharge opening 31 of the control case 30, which is explained below, and a cold air accommodating outlet 28 in communication with the cold air passage 23 disposed in the cold air passage duct 20.

A detailed structure of the control case 30 related to the present disclosure is described in more detail below, together with the description of the knob 40, with reference to FIG. 5.

Figure 3:
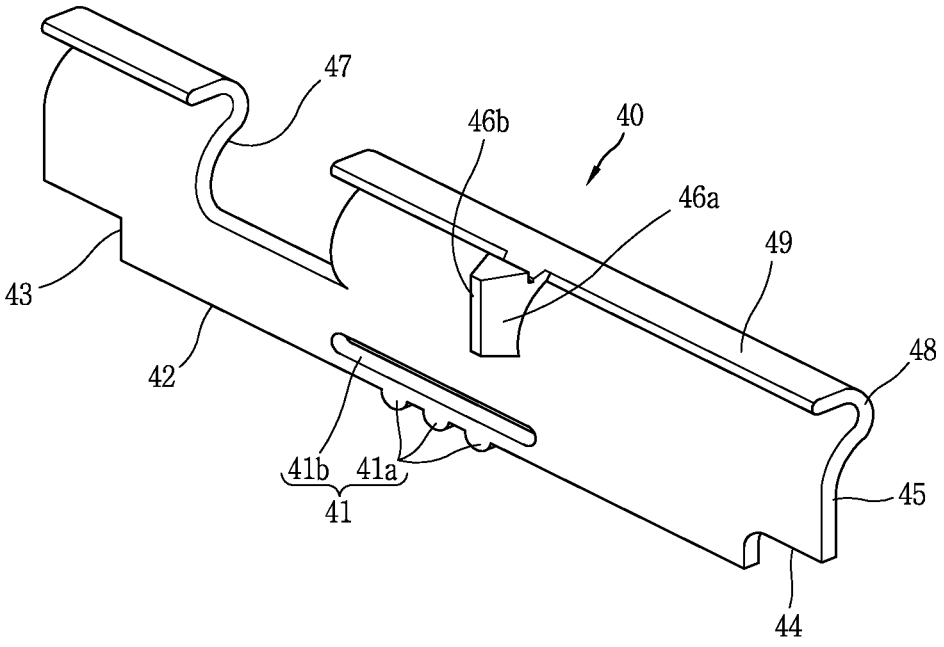
FIG. 3 is a perspective view of a knob in accordance with one embodiment of the present disclosure.
Figure 4:
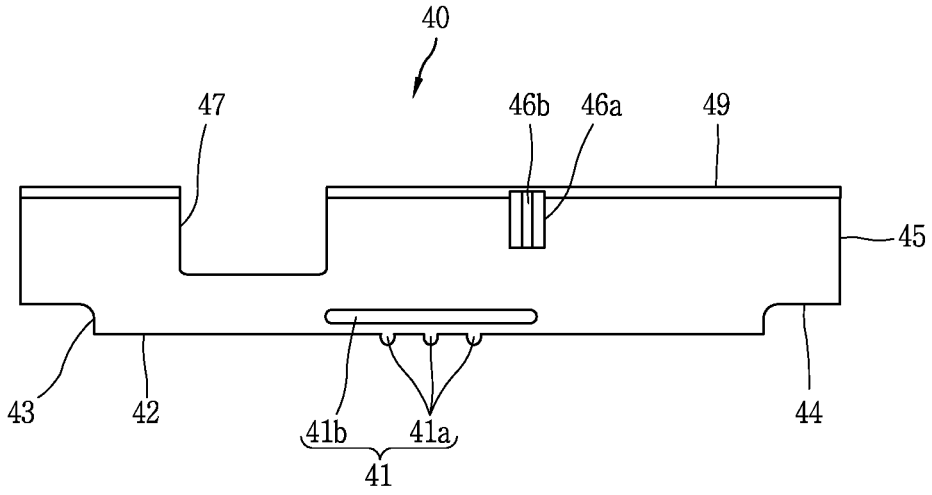
FIG. 4 is a front view of the knob illustrated in FIG. 3.

FIG. 3 is a perspective view of the knob 40 in accordance with an embodiment of the present disclosure. FIG. 4 is a front view of the knob 40 illustrated in FIG. 3. Hereinafter, a structure of the knob 40 will be described as illustrated in FIGS. 3 and 4.

Figure 5:
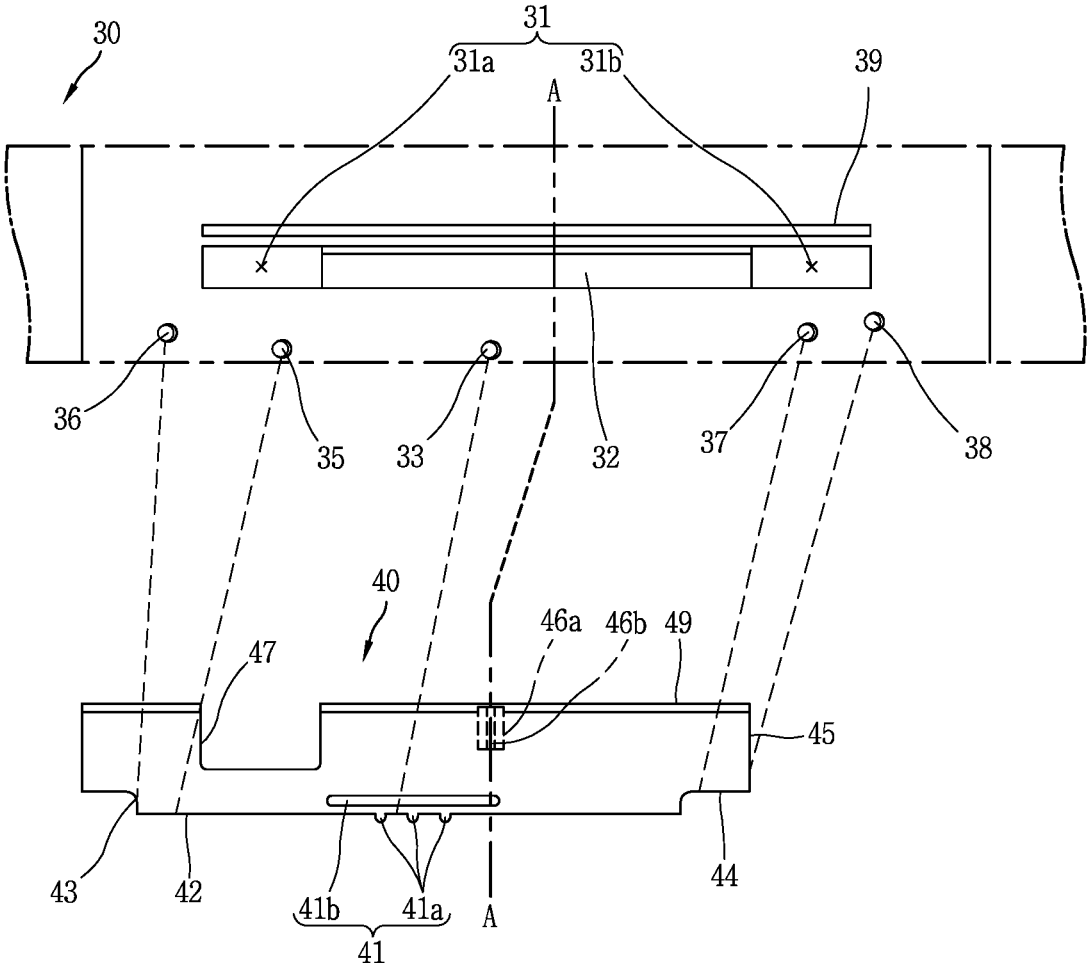
FIG. 5 is a conceptual view illustrating relationship between a control case and the knob.

The knob 40 functions to open and/or close at least part of the cold air discharge opening 31 illustrated in FIG. 5. The knob 40 may be disposed between the cold air passage duct 20 and the control case 30. The knob 40 may be installed at the control case 30 so as to be reciprocally movable in one direction.

The knob 40 may include a flow rate adjusting portion 41. The flow rate adjusting portion 31 may adjust a flow rate of cold air by adjusting a communicating area between a cut portion 47 (explained in more detail below) and the cold air discharge opening 31. The flow rate adjusting portion 41 may include a plurality of protrusions 41*a* and a slot 41*b*.

The plurality of protrusions 41*a* may be disposed at a lower end portion of the knob 40. The protrusions 41*a* may be spaced apart from one another by a preset distance. FIG. 3 illustrates one example showing three protrusions 41*a* at the lower end portion of the knob 40. During a movement of the knob 40 in one direction, the plurality of protrusions 41*a* sequentially move over a pressing protrusion 33 (explained in more detail below). Accordingly, an opening and/or closing amount or level of the cold air discharge opening 31 may be adjusted.

The slot 41*b* which is cut off in one direction may be formed at a position adjacent to the lower end portion of the knob 40 with the plurality of protrusions 41*a*. The slot 41*b* may enable an elastic transformation of the lower end portion of the knob 40 in a state in which the plurality of protrusions 41*a* are pressed by the pressing protrusion 33, thereby reducing a concentration of stress applied to the knob 40 and the pressing protrusion 33 and minimizing a risk of damage. The slot 41*b* may be understood as an elastic space in which the lower end portion of the knob 40 with the plurality of protrusions 41*a* is elastically transformed.

FIGS. 3 and 4 illustrate one example in which the plurality of protrusions 41*a* protrude from the lower end portion of the knob 40 with predetermined intervals from one another in a lengthwise direction. However, a plurality of protrusions 41*c* may be formed within a slot 41*d*, which is described in more detail below with reference to FIG. 11.

The knob 40 may include first, second, third, and fourth movement limit end portions 42, 43, 44 and 45, a stopping portion 46*a*, a cut portion 47, and a bent portion 48. Hereinafter, moving directions (up, down, left, right) of the knob 40 are defined relative to the front view of FIG. 4.

The first movement limit end portion 42 is provided at a lower end of the knob 40, and brought into contact with a first protruding portion 35 (explained in more detail below) so as to limit a downward movement of the knob 40 and guide a lateral movement of the knob 40. For example, the first movement limit end portion 42 may be formed at a position adjacent to the plurality of protrusions 41*a* which downwardly protrude from the lower end portion of the knob 40.

The second movement limit end portion 43 is stopped by a second protruding portion 36 (explained in more detail below) so as to limit a movement of the knob 40 in one side direction. The second movement limit end portion 43 may be formed in a manner of cutting off a lower end portion of one side of the knob 40 to be connected to the first movement limit end portion 42. The drawing illustrates one example in which the second movement limit end portion 43 is formed by cutting off an edge portion of a left lower end of the knob 40 and stopped by the second protruding portion 36 so as to limit a left movement of the knob 40.

The third movement limit end portion 44 may be formed by cutting off a lower end portion of another side of the knob 40. The third movement limit end portion 44 is stopped by a third protruding portion 37 (explained in more detail below) so as to limit a downward movement of the knob 40 and guide a lateral movement of the knob 40. The drawing illustrates one example in which the third movement limit end portion 44 is formed by cutting off a right lower end portion of the knob 40.

The fourth movement limit end portion 45 may be connected to the third movement limit end portion 44. The fourth movement limit end portion 45 is stopped by a fourth protruding portion 38 to limit a movement of the knob 40 in another side direction. Referring to the drawing, the fourth movement limit end portion 45 may be understood as an end portion formed at a right side of the knob 40.

The stopping portion 46*a* may be formed to be bent from an upper end portion of the knob 40 toward a knob coupling portion 32 so as to be slidably stopped in the knob coupling portion 32. The stopping portion 46*a* may be formed to cover the knob coupling portion 32 of the control case 30. Also, the stopping portion 46*a* enables the knob 40 to be located between the control case 30 and the cold air passage duct 20.

A knob handle 46*b* may protrude from the stopping portion 46*a* toward a front side. A user may manipulate the knob handle 46*b* in a generally left and right direction such that the knob 40 can be slid. This enables the cut portion 47 of the knob 40 to communicate with the cold air discharge opening 31, thereby adjusting the opening and closing amount of the cold air discharge opening 31.

The knob handle 46*b* may be disposed at a front side of the control case 30 to be manipulated by the user.

Figure 6:
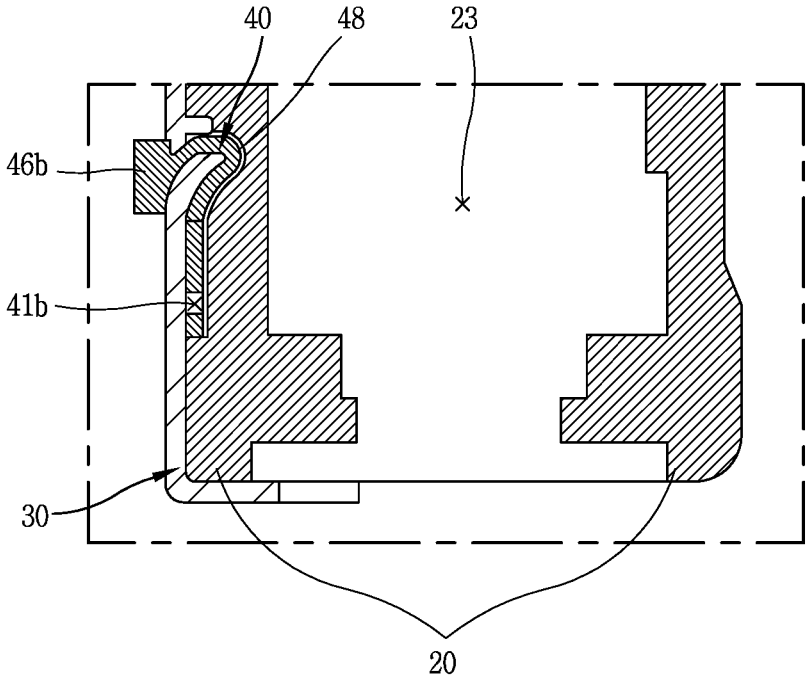
FIG. 6 is a side sectional view taken along the line A-A' of FIG. 5.

FIG. 6 illustrates the structure in which the stopping portion 46*a* of the knob 40 covers the control case 30 such that the knob 40 is disposed between the control case 30 and the cold air passage duct 20.

The cut portion 47 may be formed by cutting off at least part of an upper portion of the knob 40 to communicate with the cold air discharge opening 31, such that at least part of one side of the cold air discharge opening 31 is open thereby to discharge the cold air. The cut portion 47 does not communicate with the cold air discharge opening 31 in a closed state of the cold air discharge opening 31, and at least part of the cut portion 47 may communicate with the cold air discharge opening 31 in an open state of the cold air discharge opening 31.

A fifth movement limit end portion 49 may be formed at an upper end portion of the knob 40. The fifth movement limit end portion 49 may be brought into contact with a limit rib 39 formed above the cold air discharge opening 31 to limit an upward movement of the knob 40 and guide a lateral movement of the knob 40. The fifth movement limit end portion 49, such as illustrated in FIG. 3, may be formed at an end portion of a bent portion 48 (explained in more detail below). In this instance, the fifth movement limit end portion 49 may be an upper end surface of the knob 40 including a curved surface.

Referring to FIGS. 3 and 6, the knob 40 may include the bent portion 48 having an upper side formed in a bent shape. Referring to FIG. 6, the knob 40 may be coupled to the knob coupling portion 32 and cover at least part of the knob coupling portion 32. Such configuration may allow the knob 40 to be more stably coupled to the control case 30. Also, with this structure, even when the knob 40 is repetitively slid, stress which is concentrated on the knob 40 may be dispersed, thereby improving durability.

FIG. 5 is a conceptual view illustrating a correspondence between the control case 30 and the knob 40 according to an embodiment of the present disclosure. FIG. 6 is a side sectional view taken along the line A-A' of FIG. 5. Hereinafter, a structure of the control case 30 and a coupling relationship between the control case 30 and the knob 40 will be described with reference to FIGS. 5 and 6.

The control case 30 may be provided with a pressing protrusion 33. The pressing protrusion may protrude from a lower portion of the cold air discharge opening 31 toward the cold air passage duct 20. The pressing protrusion 33 may press the plurality of protrusions 41*a* and be settled between the plurality of protrusions 41*a*, thereby adjusting the opening and closing amount of the cold air discharge opening 31. FIG. 5 illustrates one example of the pressing protrusion 33 that protrudes from the lower portion of the cold air discharge opening 31 formed on the control case 30 with being spaced apart from the lower portion by a predetermined distance.

The control case 30 may include first and second protruding portions 35 and 36.

The first protruding portion 35 may protrude from a left lower side of the cold air discharge opening 31 toward the cold air passage duct 20. The first protruding portion 35 may be brought into contact with the first movement limit end portion 42 located at the lower end of the knob 40 so as to limit the downward movement of the knob 40 and guide the lateral movement of the knob 40.

The second protruding portion 36 may be spaced apart from the first protruding portion 35 and protrude toward the cold air passage duct 20 so as to limit the lateral movement of the knob 40. For example, regarding the embodiment illustrated in FIG. 5, the second protruding portion 36 disposed at a left side of the pressing protrusion 33 may be stopped by the second movement limit end portion 43 so as to limit the left movement of the knob 40.

The control case 30 may further include third and fourth protruding portions 37 and 38.

The third protruding portion 37 may protrude from a right lower side of the cold air discharge opening 31 toward the cold air passage duct 20. The third protruding portion 37 may be brought into contact with the third movement limit end portion 44 so as to limit the downward movement of the knob 40 and guide the lateral movement of the knob 40.

The fourth protruding portion 38 may be disposed at a right side of the third protruding portion 37 with a spaced distance to limit the lateral movement of the knob 40, and protrude toward the cold air passage duct 20. The fourth protruding portion 38 may be stopped by the fourth movement limit end portion 45 so as to limit the rightward movement of the knob 40. For example, regarding the embodiment illustrated in FIG. 4, the fourth protruding portion 38 is stopped by the fourth movement limit end portion 45 so as to limit the rightward movement of the knob 40.

Referring to FIG. 5, the pressing protrusion 33 may be disposed below the cold air discharge opening 31 of the control case 30 and be spaced apart from the cold air discharge opening 31, the first and second protruding portions 35 and 36 may be sequentially disposed at the left side of the pressing protrusion 33, and the third and fourth protruding portions 37 and 38 may be sequentially disposed at the right side of the pressing protrusion 33.

The control case 30 may further include the knob coupling portion 32. The knob coupling portion 32 may be formed between both sides of the cold air discharge opening 31 and be spaced apart from an upper portion of the cold air discharge opening 31 by a predetermined distance. The cold air discharge opening 31 may be formed at each of both sides of the knob coupling portion 32. The cold air discharge opening 31 formed at the left side of the control case 30 of FIG. 5 may be referred to as a first cold air discharge opening 31*a*, and the cold air discharge opening 31 formed at the right side of the control case 30 may be referred to as a second cold air discharge opening 31*b*.

Regarding the first and second cold air discharge openings 31*a* and 31*b*, in a state in which the knob 40 is attached to the knob coupling portion 32 so as to be reciprocally movable, the first cold air discharge opening 31*a* may communicate with the cut portion 47 of the knob 40 so as to be open. In this instance, the fourth movement limit end portion 45 may open the second cold air discharge opening 31*b*. As such, the first and second cold air discharge openings 31*a* and 31*b* may be opening and closing at the same time in response to the reciprocal movement of the knob 40.

The first and second cold air discharge openings 31*a* and 31*b* may be opened in a manner of always having the same area. More specifically, a width of the first cold air discharge opening 31*a* in a left and right direction may be the same as a width of the cut portion 47 in the left and right direction. Also, a distance from one end of a right side of the cut portion 47 to the fourth movement limit end portion 45 may be the same as a distance in the left and right direction of the knob coupling portion 32 disposed between the first and second cold air discharge openings 31*a* and 31*b*.

The cold air discharge opening 31 may be formed by dividing both sides thereof into the first and second cold air discharge openings 31*a* and 31*b*. The first and second cold air discharge openings 31*a* and 31*b* may always have the same area in the open state of the knob 40. Such structure may prevent more cold air from being supplied through one side of the cold air discharge opening 31, and allow the cold air to be uniformly supplied into the refrigerating chamber 11.

A limit rib 39 to limit the upward movement of the knob 40 may protrude above the cold air discharge opening 31. The limit rib 39 may be brought into contact with the fifth movement limit end portion 49 located at the upper side of the knob 40, to limit the upward movement of the knob 40 and guide the lateral movement of the knob 40.

Figure 7:
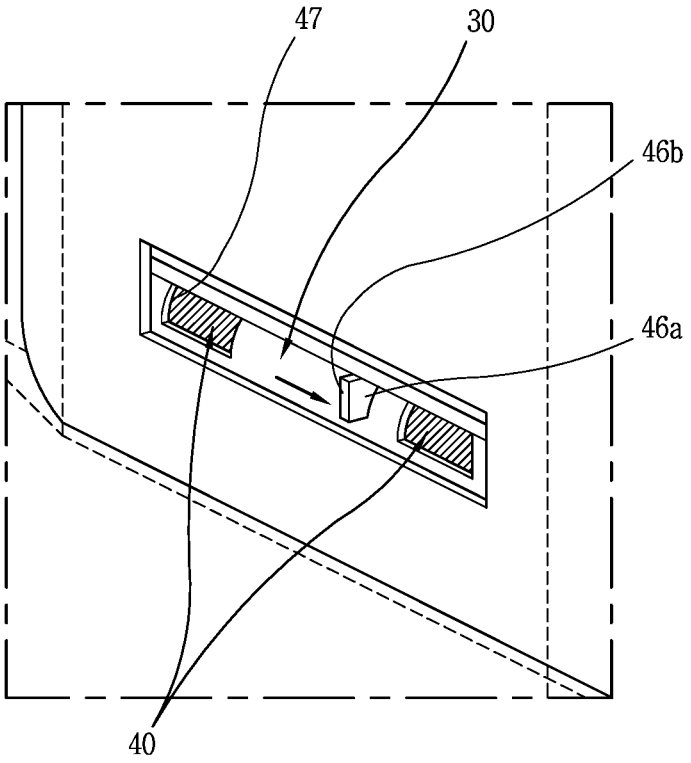
FIG. 7 is a conceptual view illustrating a closed state of a cold air discharge opening by the knob in accordance with the present disclosure.
Figure 8:
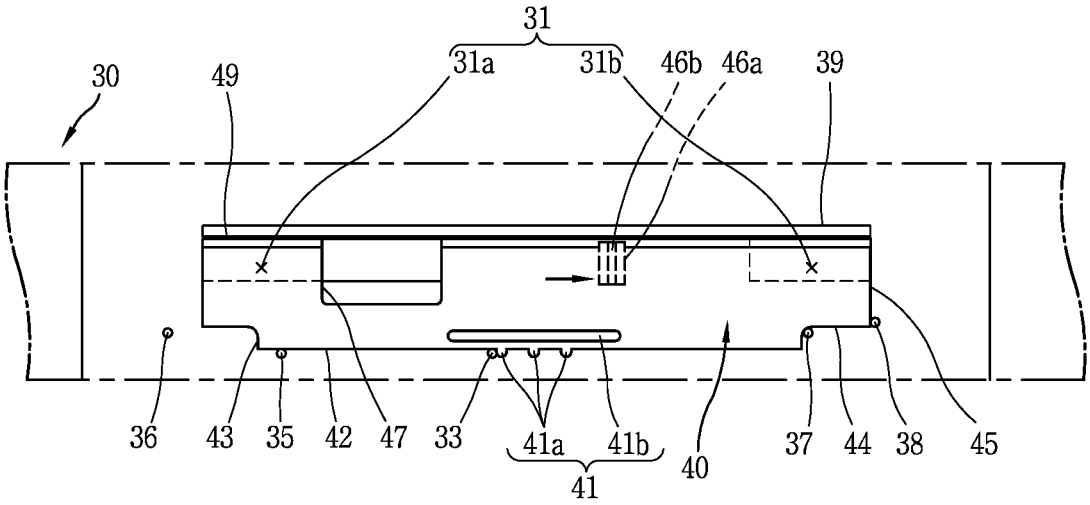
FIG. 8 is a conceptual view illustrating a coupling relationship between the knob and the control case in the state of FIG. 7.
Figure 9:
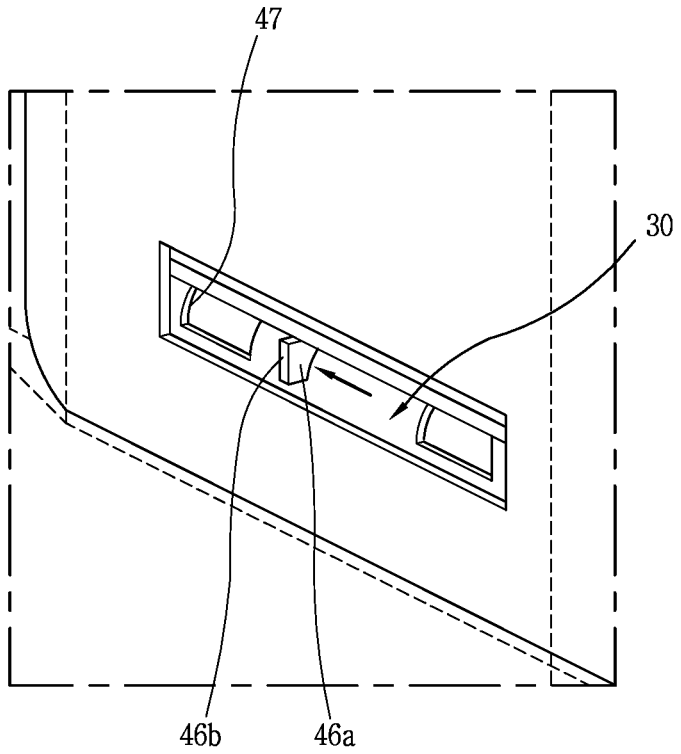
FIG. 9 is a conceptual view illustrating an open state of the cold air discharge opening by the knob according to the present disclosure.
Figure 10:
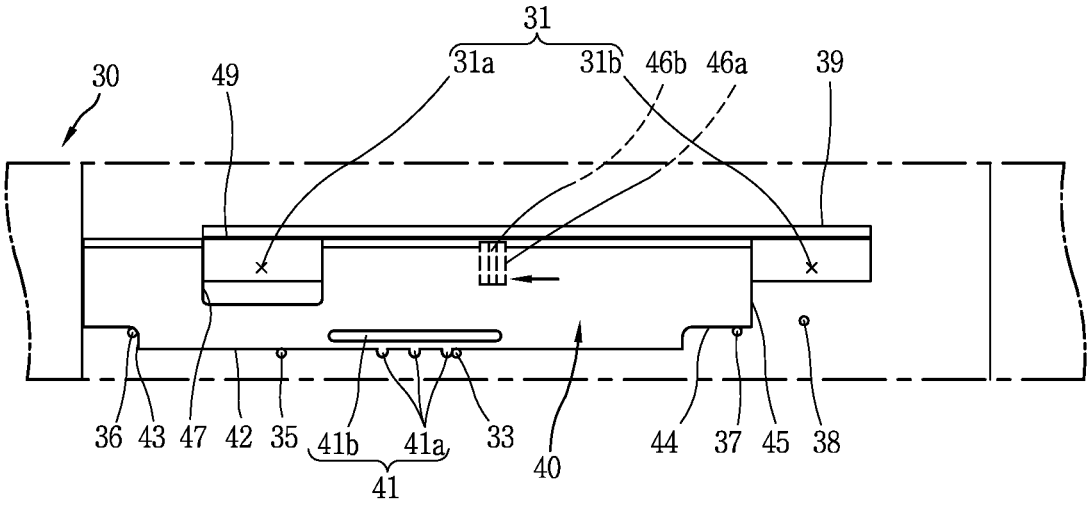
FIG. 10 is a conceptual view illustrating a coupling relationship between the knob and the control case in the state of FIG. 9.

FIG. 7 is a conceptual view illustrating a closed state of the cold air discharge opening 31 by the knob 40 in accordance with an embodiment of the present disclosure. FIG. 8 is a conceptual view illustrating a coupling relationship between the knob 40 and the control case 30 in the state of FIG. 7. FIG. 9 is a conceptual view illustrating an open state of the cold air discharge opening 31 by the knob 40 according to the present disclosure. FIG. 10 is a conceptual view illustrating a coupling relationship between the knob 40 and the control case 30 in the state of FIG. 9. Hereinafter, operations of the knob 40 installed on the control case 30 related to the refrigerator 100 according to an embodiment of the present disclosure will be described with reference to FIGS. 5, 7, 8, 9, and 10.

FIGS. 7 and 8 illustrate a state in which the knob 40 is moved in an arrow direction and closes the first and second cold air discharge openings 31*a* and 31*b*. In this state, the fourth movement limit end portion 45 may be brought into contact with the fourth protruding portion 38, and the first and third movement limit end portions 42 and 44 may be brought into contact with the first and third protruding portions 35 and 37, respectively, so as to limit the downward movement of the knob 40 and guide the lateral movement of the knob 40. The second protruding portion 36 may be spaced apart from the second movement limit end portion 43.

The first cold air discharge opening 31*a* may be closed by a portion of the knob 40 located near the left side of the cut portion 47 of the knob 40, and the second cold air discharge opening 31*b* may be closed by a portion of the knob 40 located near the fourth movement limit end portion 45.

FIGS. 9 and 10 illustrate a state in which the knob 40 is moved in an arrow direction and opens the first and second cold air discharge openings 31*a* and 31*b*. In this state, the second movement limit end portion 43 may be brought into contact with the left second protruding portion 36, and the first and third movement limit end portions 42 and 44 may be brought into contact with the first and third protruding portions 35 and 37, to limit the downward movement of the knob 40 and guide the lateral movement of the knob 40. The fourth protruding portion 38 may be spaced apart from the fourth movement limit end portion 45.

As the knob 40 is moved in a manner that the cut portion 47 communicates with the first cold air discharge opening 31*a* and the fourth movement limit end portion 45 is disposed at the left side of the second cold air discharge opening 31*b*, both of the first cold air discharge opening 31*a* and the second cold air discharge opening 31*b* are open.

FIGS. 7, 8, 9, and 10 illustrate examples in which the cold air discharge opening 31 is fully closed and fully opened. However, it is understood that the knob 40 may be manipulated to open only a part of the cold air discharge opening 31. Even when the cold air discharge opening is only partially opened, the first cold air discharge opening 31*a* and the second cold air discharge opening 31*b* have the same area.

One of the plurality of protrusions 41*a* may be pressed by the pressing protrusion 33 and another one of the plurality of protrusions 41*a* may move over the pressing protrusion 33. Thus, when the one protrusion of the plurality of protrusions 41*a* is pressed by the pressing protrusion 33, the lower end portion of the knob 40 is elastically transformed upwardly.

In a state in which the pressing protrusion 33 is disposed between the neighboring protrusions of the plurality of protrusions 41*a*, the cold air discharge opening 31 is adjusted to be open by a predetermined area.

Figure 11:
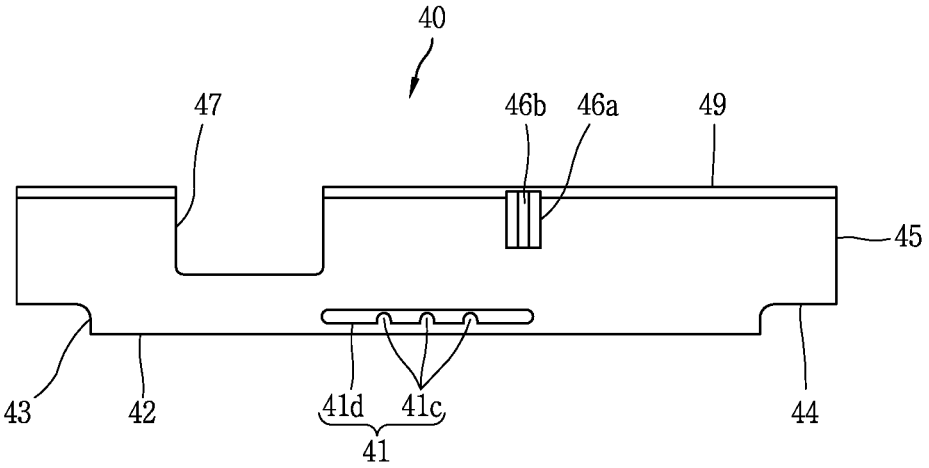
FIG. 11 is a front view of a knob in accordance with another embodiment of the present disclosure.

FIG. 11 is a front view of the knob 40 in accordance with another embodiment of the present disclosure.

As discussed with respect to the knob illustrated in FIG. 5, the knob 40 of FIG. 11 is configured to open and close at least part of the cold air discharge opening 31. The knob 40 may be disposed between the cold air passage duct 20 and the control case 30, and installed on the control case 30 to be reciprocally movable in one direction.

The knob 40 may include the flow rate adjusting portion 41. The flow rate adjusting portion 41 can adjust the flow rate of cold air by adjusting a communicating area between the cut portion 47 and the cold air discharge opening 31. The flow rate adjusting portion 41 may include a plurality of protrusions 41*c* and a slot 41*d*.

The knob according to the embodiment illustrated in FIG. 11 is different than the knob according to the embodiment illustrated in FIG. 5 regarding the plurality of protrusions 41*c* and the slot 41*d*. Unlike the knob of FIG. 5, in which the plurality of protrusions 41*a* are disposed at the lower end portion of the knob 40 with being spaced apart from one another by the preset intervals, the plurality of protrusions 41*c* according to the know of FIG. 11 upwardly protrude from a lower side within the slot 41*d*.

The slot 41*d* which is cut in one direction is formed at a position adjacent to a lower end of the knob 40. Also, FIG.

11 illustrates that the protrusions 41*c* of the knob 40 upwardly protrude from the lower side within the slot 41*d*.

Although not illustrated, the pressing protrusion 33 of the control case 30 may be disposed to be inserted into the slot 41*d* so as to press the plurality of protrusions 41*c*. When the plurality of protrusions 41*c* are pressed by the pressing protrusion which is inserted into the slot 41*d*, the lower end portion of the knob 40 is elastically transformed downwardly. The slot 41*d* may be understood as an elastic space in which the lower end of the knob 40 is elastically transformed.

The plurality of protrusions 41*c* may be sequentially moved over the pressing protrusion 33 while the knob 40 moves in one direction, and the pressing protrusion 33 may be disposed between the protrusions 41*c*. Accordingly, an opening and closing amount of the cold air discharge opening 31 is adjusted.

The slot 41*d* may allow for the elastic transformation of the lower end portion of the knob 40 in the state in which the plurality of protrusions 41*c* are pressed by the pressing protrusion 33, thereby reducing a concentration of stress applied to the knob 40 and the pressing protrusion 33 and minimizing a risk of damage.

For purposes of convenience, the coupling relationship between the knob and other components or operations of the knob according to the embodiment illustrated in FIG. 11 will be understood by the description of the knob according to the embodiment shown in FIG. 5.

As described, in the refrigerator according to the present disclosure, the pressing protrusion may be provided on the control case and the flow rate adjusting portion pressed by the pressing protrusion may be provided on the knob, which may allow for adjusting an opening and closing amount of the cold air discharge opening in a manual manner.

Furthermore, as described, in replacement of a damper which is controlled electrically, the knob coupling portion may be formed on the cold air discharge opening and the stopping portion may be slidably coupled to the knob coupling portion, thereby enabling a manual manipulation of the knob. This may result in reducing power consumption and material costs and implementing user-desired temperature.

Furthermore, as described, both sides of the cold air discharge opening which are adjacent to the knob coupling portion may always have the same area in an open state of the knob, thereby uniformly supplying cold air into a refrigerating chamber through the both sides of the cold air discharge opening.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body having a refrigerating chamber therein;

a cold air passage duct disposed within the main body, the cold air passage duct including a cold air passage to discharge cold air into the refrigerating chamber;

a control case attached at one surface of the cold air passage duct, the control case including a cold air discharge opening through which the cold air is discharged; and a knob provided between the cold air passage duct and the control case, the knob being reciprocally movable in one direction to open and close at least a part of the cold air discharge opening, wherein the control case comprises a pressing protrusion to press against a lower end portion of the knob, the pressing protrusion provided below the cold air discharge opening and protruding toward the cold air passage duct, wherein the knob comprises a flow rate adjusting portion to adjust an opening and closing amount of the cold air discharge opening in response to being pressed by the pressing protrusion, wherein the flow rate adjusting portion comprises:

a plurality of protrusions disposed at the lower end portion of the knob that are spaced apart from one another by a preset distance, and a slot cut off to enable an elastic transformation of the lower end portion of the knob when the protrusions are pressed by the pressing protrusion, wherein the pressing protrusion is disposed to be inserted inside the slot cut off so as to press against the plurality of protrusions.

2. The refrigerator of claim 1, wherein the control case further comprises a knob coupling portion formed between a first side and a second side of the cold air discharge opening, and the knob coupling portion configured to slidably guide movement of the knob.

3. The refrigerator of claim 2, wherein the knob comprises:

a stopping portion that is bent from an upper end portion of the knob toward the control case so as to be slidably stopped in the knob coupling portion; and a knob handle that protrudes from the stopping portion toward a front side, the knob handle being disposed at a front side of the control case.

4. The refrigerator of claim 3, wherein the stopping portion is bent toward the knob coupling portion, whereby the knob is slidably coupled to the knob coupling portion.

5. The refrigerator of claim 2, wherein the knob include a bent portion having an upper side formed in a bent shape.

6. The refrigerator of claim 2, wherein the knob comprises a cut portion, the cut portion formed by cutting off at least part of an upper portion of the knob, whereby the cut portion is communicably coupled with the cold air discharge opening such that the cold air is discharged by opening at least part of one of the first side or the second side of the cold air discharge opening.

7. The refrigerator of claim 2, wherein the knob coupling portion is spaced apart from an upper portion of the cold air discharge opening by a predetermined distance, wherein the knob is slidably coupled to the control case.

8. The refrigerator of claim 2, wherein the cold air discharge opening is disposed at each of both sides of the knob coupling portion, and both the first and second sides of the cold air discharge opening are configured to discharge the cold air therethrough such that one of the first and second cold air discharge openings is open while the other of the first and second cold air discharge openings is open in response to at least part of the other of the first and second cold air discharge opening communicating with the cut portion.

9. The refrigerator of claim 8, wherein the first and second cold air discharge openings have the same area in a state of being opened and closed by the knob thereby allowing cold air to be uniformly supplied into the refrigerating chamber through the first and second cold air discharge openings.

10. The refrigerator of claim 1, wherein the plurality of protrusions protrude upward from a lower side within the slot cut off to elastically transform the lower end portion of the knob in a downward direction in a state in which one of the plurality of protrusions is pressed by the pressing protrusion.

11. The refrigerator of claim 1, wherein the plurality of protrusions protrude downward from the lower end portion of the knob to elastically transform the lower end portion of the knob in an upward direction in a state in which one of the plurality of protrusions is pressed by the pressing protrusion.

* * * * *